US009379503B2

(12) United States Patent
Bonzi et al.

(10) Patent No.: US 9,379,503 B2
(45) Date of Patent: Jun. 28, 2016

(54) ELECTRIFIED RAIL FOR POWERING METAL SHELVING UNITS AND METHOD FOR MANUFACTURING THE SAME

(71) Applicant: CEFLA SOCIETA' COOPERATIVA, Imola (IT)

(72) Inventors: Giancarlo Bonzi, Imola (IT); Eros Nanni, Castel San Pietro (IT)

(73) Assignee: Cefla Societa' Cooperativa, Imola (IT)

( * ) Notice: Subject to any disclaimer, the term of this patent is extended or adjusted under 35 U.S.C. 154(b) by 37 days.

(21) Appl. No.: 14/445,812

(22) Filed: Jul. 29, 2014

(65) Prior Publication Data

US 2015/0037991 A1 Feb. 5, 2015

(30) Foreign Application Priority Data

Jul. 31, 2013 (BO) ..... BO2013A000415

(51) Int. Cl.

| | |
|---|---|
| ***H01R 25/16*** | (2006.01) |
| ***H01R 25/14*** | (2006.01) |
| ***H01R 4/48*** | (2006.01) |
| ***H01R 13/03*** | (2006.01) |
| ***H01R 43/00*** | (2006.01) |

(52) U.S. Cl.

CPC ..... *H01R 25/164* (2013.01); *H01R 4/48* (2013.01); *H01R 13/035* (2013.01); *H01R 25/14* (2013.01); *H01R 43/00* (2013.01); *Y10T 29/49181* (2015.01)

(58) Field of Classification Search

CPC ..... H01R 25/14; H01R 25/164; H01R 43/00; Y10T 29/49181

USPC ..... 439/216; 29/861

See application file for complete search history.

(56) References Cited

U.S. PATENT DOCUMENTS

| | | | | |
|---|---|---|---|---|
| 4,121,879 | A * | 10/1978 | Olsen | H01R 25/142 436/117 |
| 4,812,134 | A * | 3/1989 | Miller | H01R 25/14 439/110 |
| 4,976,633 | A * | 12/1990 | Beghelli | F21V 21/02 362/404 |
| 5,348,485 | A * | 9/1994 | Briechle | H01R 25/14 439/110 |
| 5,485,933 | A * | 1/1996 | Crooymans | A47F 5/0846 211/153 |
| 7,122,744 | B2 * | 10/2006 | Walter | A47B 97/00 174/161 R |
| 7,425,140 | B2 * | 9/2008 | Lehman | H01R 25/14 439/115 |
| 8,286,768 | B2 * | 10/2012 | Schmiedle | H01R 25/145 174/68.2 |
| 8,968,011 | B2 * | 3/2015 | Hoffmeister | H01R 25/142 439/110 |
| 2008/0166006 | A1 * | 7/2008 | Hankey | H01R 13/2428 381/375 |

* cited by examiner

*Primary Examiner* — James Harvey
*Assistant Examiner* — Oscar C Jimenez
(74) *Attorney, Agent, or Firm* — Stetina Brunda Garred & Brucker

(57) ABSTRACT

An electrified rail for metal shelving units, the rail comprising a body of electrically insulating material, provided with longitudinal slots. Each slot having a wire of electrically conducting metal surrounded for more than 180° of its cross section by the walls of the respective slot, the remaining section of the wires being exposed for electric contact. The body of the rail being formed to allow transversal elastic deformation of the rail itself after the surrounding and holding of the wires the slots are open on a visible planar side of the rail body with longitudinal mouths having a width always inferior to the diameter of wires, the wires being held in slots by the monolithic body of the rail itself, while through the narrow mouths of said slots every electric wire can be reached by the devices mounted on the rail.

8 Claims, 4 Drawing Sheets

ELECTRIFIED RAIL FOR POWERING METAL SHELVING UNITS AND METHOD FOR MANUFACTURING THE SAME

CROSS REFERENCE TO RELATED APPLICATIONS

The present application claims priority to Italian Patent Application No. BO2013A000415 filed Jul. 31, 2013, the contents of which are expressly incorporated herein by reference.

STATEMENT RE: FEDERALLY SPONSORED RESEARCH/DEVELOPMENT

Not Applicable.

BACKGROUND OF THE INVENTION

The present invention is classified under international classes H01R and G09F, and relates to an electrified rail, in particularly for metal shelving units which have to be provided, on the side facing the public of the shelves supporting goods, with electronic labels, displays and/or other peripherals. Moreover the present invention relates to the method for producing such electrified rail.

As prior art, the following documents are cited.

Patent application WO 1994/22125 titled "Information display rail system" describes an extruded rail with a C-profile, to be fixed on the front side of the shelves. The rail is provided with a longitudinal top ridge into which an electrically insulating base carrying longitudinally fixed powered wires, opportunely distanced from each other. The wires are fixed with adhesive to said base for about 180° of their section, and protrude downwardly with the remaining free end, with which the spring-loaded ends of an electronic label designed to be fixed into said rail can be brought into contact.

U.S. Pat. No. 5,348,485 titled "Electronic price display system with vertical rail", also published in 1994, describes a system to connect, through electric wires and plugs, electrified rails positioned on the front of goods-displaying shelves, on which electronic labels are fixed, with a vertical electrified rail, fixed on the uprights of the same shelving unit. The rail is made of an extruded bar inside which electrically conducting metal strips are fixed, with the interposition of an electrically insulating base, the metal strip being fixed through adhesive. The exposed surface of metal strip is touched by flexible spring-loaded electric contacts of end plugs of said connecting wires, said plugs being fixed on said vertical rail, whose electric conductor are connected with their top end to means positioned on the top part of the shelving unit, the means providing supply and control of said electronic labels.

French patent FR 2 765 018 titled "Systeme d'etiquette electronique d'affichage" filed in 1997, describes an electrified rail made of an extruded plastic bar, having a C-profile, on whose bottom is fixed for all its extension an electrically insulating base, on which metal strips are longitudinally fixed through adhesive. Said metal strips are connected with one end to supply and/or control means, while the rail is profiled so as to fix an electronic label having on its rear spring-loaded contacts touching said metal strips, to realize the necessary connection of electronic label with remote supply and control means.

GB patent 1273670 (A) describes a current supply bar comprising an elongate metal support connected by lugs to a wall or ceiling, a flexible strip of insulating material held in the support by flanges, and metal conductors. The strip is provided with grooves into which the conductors are laid when it is flat but which retain the conductors when the strip is bent about its longitudinal axis. The strip is also provided with cavities and/or elevations between the conductors.

U.S. Pat. No. 2,234,745 (A) describes an electric connecting device comprising a rail formed from flexible dielectric material, like for instance rubber. It is provided with a base having flanges whereby the device may be secured in position. Extending through the device and opening at the top edge thereof are two interspaced grooves separated by a centrally arranged ridge. The spacing of the grooves and therefore the width of the ridge is such that the grooves will receive the prongs of a connector. Outer walls are provided on the rail and in the inner face of each of these walls is formed a semi-circular groove in each of which is mounted one of the bus bars made from flexible wire coiled in the form of a helix. When assembling the bus bars in the rail, the bars may be slipped endwise into the grooves while separating the walls slightly so as to allow the bars to be forced down into the grooves until they come opposite the semi-circular grooves, whereupon they will snap into position and will resiliently held in place.

The prior art and all the state of the art known in this technical field have the following limitations:

Referring to the electric conductors of all rails, be they in the form of wires or strips, the part of their surface which is not fixed to support insulating material is visible and easily reachable by a person's fingers, with ensuing safety problems, both for the persons and the electronic labels, whose contacts may be damaged by electrostatic shocks deriving from accidental contacts.

Another disadvantage of the known state of the art is the poor reliability in the fixing of electric conductors to supporting rail through adhesives, whose features tend to modify over time, due to the heating electric conductors undergo because of Joule effect. To remedy this problem, the teaching of U.S. Pat. No. 5,890,918 may be used, which describes how to realize an electrified rail using an extruded body of hard material, also electrically conducing, providing said body with a longitudinal slot with a circular section, outwardly open with a part lower than 180° of its section. In said slot a copper wire is inserted through pressure, the wire being insulated through a sheath of plastic material, having an external diameter equal to the diameter of said slot, so that the same wire can be pressure-inserted and can remain friction-trapped in said slot, which surrounds it for more than 180° of its electrically insulating external sheath. This solution entails the use of pointed pins on plugs and peripherals; the point must be able to pierce wire insulation and to touch the same copper wire to establish the needed electrical contact. This solution entails also very high contact resistances, due to the limited surface contact between pointed pins and conductor wire. Insulation piercing technique needs a strong force to allow the contact point to pierce wire insulation and to touch the wire itself, deforming it to ensure an efficient contact. In U.S. Pat. No. 5,890,918 said force is obtained through a screwable contact in a corresponding seat of the electrified rail. If we consider that every contact must have its own electric insulation and a robust threaded body to ensure a resistant screwing in the electric rail seat, e.g. three or four electric conductors, it is easy to understand that miniaturising the electrified rails and the relative contact plugs becomes very difficult, according to U.S. Pat. No. 5,890,918. Other disadvantages come from the fact that screwable plugs can be subjected to loosening caused by vibrations, with diagnostic and maintenance difficulties. Further disadvantages derive from the fact that every time the peripheral is moved on the electrified rail, other tracts of wire must be pierced, while the previously pierced areas remain exposed, with ensuing problems of electric insulation and oxidation. The same U.S. Pat. No. 5,890,918 patent, as an alternative to the above illustrated solution, teaches to realize the rail with an electrically insulating material, with longitudinal slots with circular section, opened toward the exterior with a part lower than 180° of their section, and inserting into every slot an insulation-free copper wire, having an external diameter equal to that of each slot, so that the wire can be pressure-inserted into the slot, taking advantage of the elasticity of the plastics forming the rail, so that the wire is pressure-trapped in the slot, which surrounds the wire for more than 180° of its section. This solution, if on one hand tries to fix electric wires to the slots of the electrically insulating rail without using adhesives, in reality tackles the problem deriving from the difficulty of keeping the wire in the slot, due to the limited undercut with whom the slot itself holds the wire, which is necessary in order to easily overcome the undercut in the step of insertion of said electric wire into relative slot through thrust. Due to the elasticity of the plastics forming the rail, if the rail is realised with a limited section, small movements of flexion and torsion of the rail itself lead to the wires inevitably coming out from the respective slots. This embodiment, too, is an obstacle for the miniaturisation of an electric rail having a plurality of conductors, and has the above-illustrated problems on the use of plugs with screwable contacts. For these reasons, this solution is hardly feasible at the industrial level, to provide tracts of electrified rail having a length of some meters, already incorporating electric wires in the plastic bar. This solution has the same disadvantages quoted above for document WO 1994/22125, in that the electric wires protrude from their relative support slot for an ample tract of their section, and for this reason can lead to accidental short circuits.

EP Patent 1 233 482 describes the realisation of an electrified bar for use at 220-230 V. In this case, too, the bar is provided with a metal body ensuring mechanical resistance, thermal resistance and linearity; in opposed and flanked positions, longitudinal slots are obtained, the slots being capable of containing plastics extrusions having in their turn deep and narrow longitudinal slots with intermediate, longitudinal and flanked recesses, capable of holding respective electric wires which in this way are sufficiently backed in the respective slots and protected against accidental contacts. This solution does not solve the problem of the miniaturisation of the electrified rail, and does not teach how to realise an electrified rail with a plurality of conductors placed side by side, with an industrial extrusion method, capable of providing bars having a limited section, the desired length and ready to use.

Finally, WO patent 9516293 (A1) describes a conductor rail comprising a bearing structure, an insulator and a conductor or conductors, according to which the bearing structure and the insulating structure of the conductor rail are produced as the same uniform structure by the extrusion method and the conductors are inserted in the rail after extrusion, which allows the bending of the rail under heating or without heating, in any direction, before the insertion of the conductors or after insertion. The conductor rail may be formed from PVC, ABS, Polypropylene, Polyethylene or Polycarbonate, or acrylic resins. No mention is made in this document from the feature that the rail can be flexed fanwise transversally before the insertion of the conductors.

SUMMARY OF THE INVENTION

All the known electrified rail use an electrically insulating PVC or similar plastic body, which offer a poor safety in terms of electric insulation, which sometimes are not self-extinguishing, and have poor capacity to resist overheating, which can develop for possible failures or overload. Moreover, they have poor resistance to mechanical deformation, already at temperatures near to 100° C. In the known electrified rails, electric wires are inserted into the plastic body after its formation, taking advantage of the deformability and of the elasticity at the relatively cold temperature of the plastics itself. In order to assume the necessary linear form of mechanical resistance, to the electrically insulating plastic body of known type an external support and rigid body is paired, generally made of metal, with further manufacturing problems and with deducible difficulties in realizing electrified rails having a limited section.

For supplying electronic labels and/or other peripherals to be fixed on metal shelving units produced by the applicant, the applicant could not find on the market an electrified rail, and had therefore to design an electrified rail having the following features:

The electrified rail must be in the form of a monolithic body of extrudable plastic material, having good features of rigidity and mechanical load, similar to those of metal, in order to have a section of limited width, a linear form and to directly support the peripherals; at the same time, it must have a good electric insulation, to directly support a plurality of naked electric wires, ensuring a good reciprocal insulation of the single wires, and outwardly; finally, it must have good fire resistance and self-extinguishing capacity, and a good capacity of resisting to mechanical deformation, even when exposed to temperature around 100° C. To this aim, the rail is preferably made of polycarbonate (PC), commercially known e.g. under Makrolon® or Lexan® brand, or in polyphenylene oxide (PPO), commercially known e.g. under Noryl® brand, or equivalent materials;

The rail must have a body with a profile capable of being fixed on a support surface; to any point of the rail electric connection plugs, electric devices or other accessories must be removably fixed; its longitudinal outward surface must be planar and provided with a plurality of slots; in each slot an electric wire is contained, having a portion of its section outwardly open, so that such part of wire can be reached by the spring-loaded pins for electric contact with plugs or devices which can be fixed on the rail itself;

The rail must be produced in tracts having a pre-defined length, e.g. two meters long, with the wires are already tightly held, and must be realised on an industrial scale with a repeatable method, a method easily integrable with the known extrusion methods for plastic material. The technical problem to be solved in the manufacturing through extrusion of a rail body with the plastic material quoted above consists in the insertion of the electric wires into the extruded rail, in that the usual technique for pressure-inserting wires into the structurally defined profile at room temperature cannot be used, as it would lead to the breakage of the profile itself and/or to inacceptable deformation of the electric wires. The present invention solved this technical problem through a particular profile of the rail body, and inserting into it the electric wires after the extrusion step. In particular, the insertion is performed during the calibration step, when the profile is still hot. In this step, the profiled and extruded rail undergoes a transversal flexion which brings the slots surrounding the electric wires to outwardly diverge and open, so as to easily insert the respective electric wires, with a continuous method. The electric wires are preferably heated to a temperature preventing thermal shock in the contact with the extruded plastic material into which they have to be inserted. Afterwards, always during the sizing step, the profiled rail is brought back to its original intended profile, so that its slots close and tightly hold the electric wires, with an undercut having a width sufficient to hinder the accidental successive loss of said wires. To check the transversal opening of the rail and to avoid the formation of unwanted stretch, a suitable profile of the slots containing the wires and of other parts of the rail itself was designed;

Electric wires must not protrude from the containing slots with a portion of their section, but they must be reachable by the electric contacts of the peripherals, only through channels having a limited width and a sufficient depth, so that immediate and accidental contacts with said wires are prevented;

The electric wires must be externally nickel- or gold-plated, and the electric spring-loaded contacts of the pins of plugs and peripherals must be plated in the same way, so as to ensure a high resistance to oxidation and a low electric contact resistance;

The rail must have limited dimensions, e.g. a width of about 20 mm, and a reduced thickness, so as to have a low aesthetic impacts, both for the formation of horizontal electrified rail, to be applied on the front end of shelves, and of vertical electrified rails, to be applied on shelving unit uprights. The vertical rail connects said horizontal rails, through wires and relative plugs, to remote supply and control means of electronic labels and/or other peripherals fixed on the same horizontal electrified rails;

The rail must have lateral and/or anterior profiles such as to allow the fixing to the rail itself of any suitable peripheral, independently from the number of conductors (two or four);

The rail must have rear and/or lateral profiles such as to render its fixing flexible to a support which can be e.g. the upright, a shelf or the back, or interposed parts, of a shelving unit.

BRIEF DESCRIPTION OF THE DRAWINGS

Other features of the invention, and the advantages it procures, will be made clearer by the following description of certain preferred embodiments of said invention, illustrated purely by way of non-restrictive example in the figures of the accompanying four sheets of drawings, in which.

DETAILED DESCRIPTION OF THE INVENTION

Figure 1:
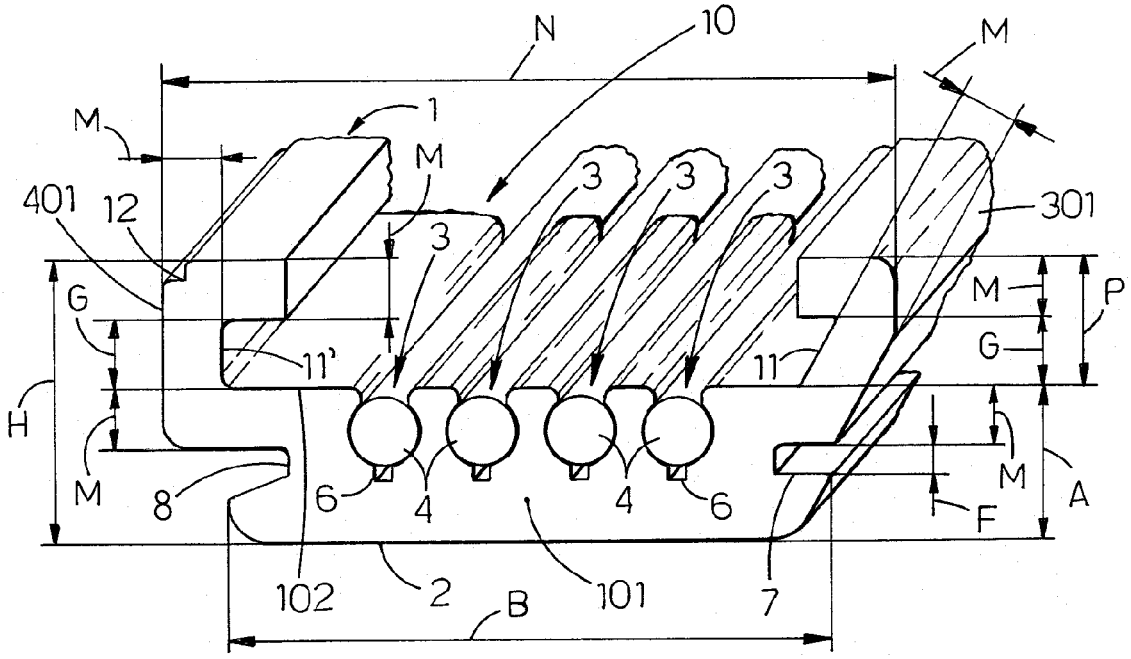
FIG. 1 shows a perspective view of the electrified rail.
Figure 2:
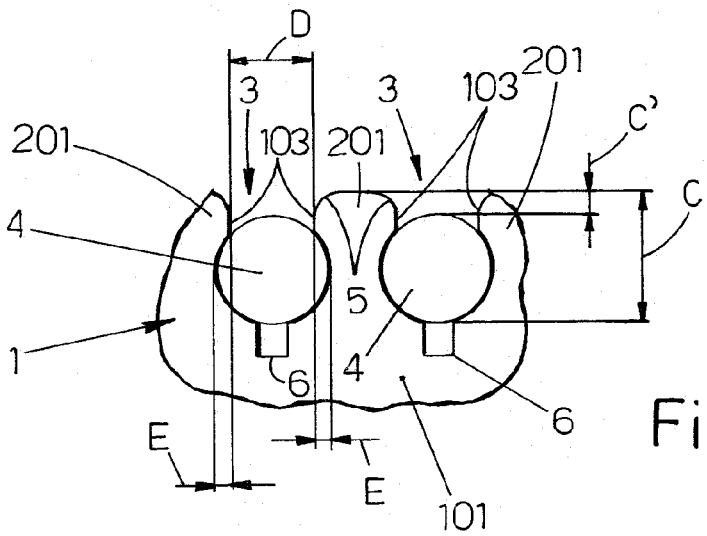
FIG. 2 shows a front section of a magnified detail of the slot profile of the rail, suitable for containing electric wires.

With reference to FIGS. 1 and 2, the electrified rail 1, according to the present invention, produced through extrusion of a PC or PPO resin, or other heat-resistant, self-extinguishing resin, having good mechanical and good electrically insulating characteristics, has a substantially U- or C-profile (see in the following). The rail has a longitudinal channel 10 and a base 101 of thickness A of about 4-4.5 mm, e.g. about 4.2 mm, a width B of about 16 mm, a planar external basal surface 2 with a superior side 102, internal to the profile; this side is planar too, and is substantially parallel to said external side 2. The rail is provided, e.g. with symmetrical disposition, with a plurality of longitudinal slots 3, e.g. four slots, capable of precisely holding corresponding metal conductors 4, e.g. in the form of copper wires or strands (see in the following). Good results were obtained using copper wires 4 having a section of 1.5-1.8 mm, e.g. about 1.78 mm, protected by a subtle nickel- or gold-plating, which renders them highly resistant to oxidation, ensuring moreover a limited contact electric resistance with plug and devices pins (see in the following), which will be connected to all or to a part of wires 4. As shown in the detail of FIG. 2, the slots 3 have a total depth C of about 2.18 mm, therefore much higher than the diameter of wire 4, which is held in the inferior tract of the slots themselves, outwardly opening with a mouth 103 having depth C' of about 0.4 mm and a width D of about 1.3 mm. Therefore, the two undercut portions through which slots 3 hold wires 4, have each a width E of about 0.25 mm. Therefore, wires 4 are in a backed position with respect to the bottom surface 102 of channel 10, and are therefore protected from accidental contacts, thanks also to the limited width of mouth 103 of slots 3 (about 1.3 mm). The portions 201 of the base separating slots 3 from each other have lateral walls substantially parallel and with external angle areas 5 suitably rounded.

On the bottom of each slot 3 small longitudinal, middle grooves 6 can be opened, wide and deep about 0.5 mm and useful for what will be explained later. The base 101 of the rail is completed by longitudinal lateral, external grooves 7 and 8, at least one for each side. These lateral grooves have preferably different profiles and dimensions, to increase the possibility of installing rail 1, and/or to pair to it external components, and also to facilitate proper orientation of the rail itself, in relation to the different intended use of the internal electric wires 4. A part of said wires can be destined to supply electric power, preferably low voltage, while the other wires can be kept as a reserve or can be used to transmit data (see in the following) or to other uses. Purely by way of non-restrictive example, the lateral groove 7 has a width F of about 0.8 mm and a substantially rectangular profile, while the groove 8 has bigger dimensions than groove 7, and a perpendicular V-profile.

On the bottom side 2 of base 101, small groove or cuts 9 may open, useful for what will be explained later, having equal or different dimensions from those of foundation grooves 6, with respect to which the same grooves 9 have a symmetrical and offset position.

Always referring to FIG. 1, rail body 1 comprises in a unique piece the ends of base 101, of opposed wings 301, 401 with a L-profile substantially overturned; the concave parts of the two wings are turned to each other, to give the rail the desired C shape, and therefore to form in it a longitudinal channel 10 with an overall overturned T profile, having opposed and parallel grooves 11, 11' on the internal longitudinal sides of the bottom surface 102, having preferably an equal highness G of about 1.85 mm, but having different depth and profile, to oblige the orientation of plugs and peripherals which can be fixed to the rail 1, with ensuing obliged contact of peripheral pins with the pre-determined wires 4 of the rail itself (see in the following). To facilitate the acknowledgment of rail 1 orientation, also in relation to the different intended use of wires 4, one of the wings, for instance wing 401, is provided in the external angle area of a longitudinal recess 12.

The thickness H of rail body 1 is about 7-8 mm and the thickness M of the various areas forming the wings and the base of the rail itself was kept constant as much as possible and near to the value of 1.6 mm, so as to uniform the shrinkage of the material of rail 1, to avoid deformation, and to ensure its production with a rectilinear shape. The depth P of channel 10 is about 3.45 mm, while the overall width N of the electrified rail 1 is about 19-20 mm.

Figure 3:
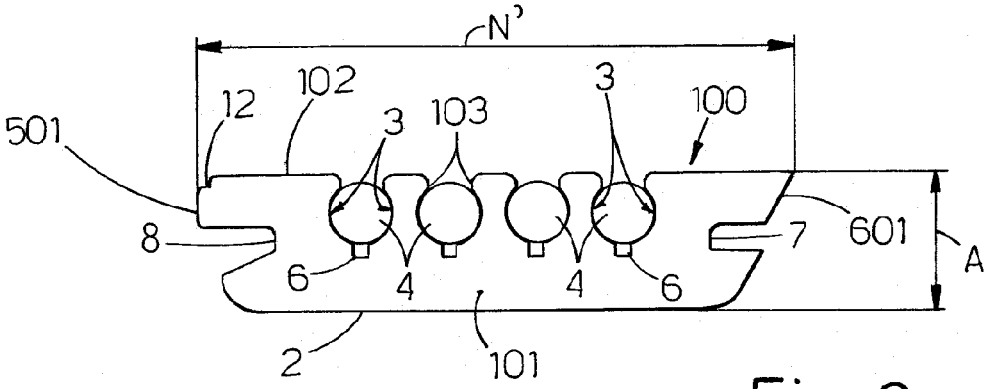
FIG. 3 shows the front profile of a rail embodiment, with limited dimensions.

According to the embodiment of FIG. 3, the electrified rail can be realized with an extruded body 100 without wings 301, 401 as in FIG. 1 embodiment, so as to have a thickness A of about 4-4.5 mm and a width N' substantially lower than 19 mm. According to FIG. 3 embodiment, the rail can be fixed on the surface of a support with its base 2 or taking advantage, in a partial or total way, of the lateral channels 7, 8. The plugs and electric devices may be fixed to the body 100 of the rail itself, taking advantage of the said lateral channels 7, 8 and/or the lateral profile of the longitudinal borders 501, 601 of surface 102. It is apparent that FIG. 3 rail has a boosted miniaturization, and has a limited aesthetic impact, even if its flexion and torsion resistance are certainly lower than those of the preferred FIG. 1 embodiment, whose wings 301, 401, with their L-profile, act as longitudinal stiffening ribbing.

The above-cited plastic material (PC, PPO) used for making the rail body 1 or 100, can be used to be extruded with a final transparent or translucent features, and therefore to manufacture a rail with a further limited aesthetic impact and suitable for the application to shelves of any colour. The grey of the nickel-plating or gold of gold-plating of electric wires 4 will contribute to ensure a pleasant aesthetic pairing of the rail itself to shelves of any colour.

The manufacturing method of the above-described electrified rail through extrusion comprises the following steps:

feeding the extruder with a suitable plastic material (e.g. PC or PPO), and extruding the profile;

the extruded profile passes to a calibration station;

in the calibration station the extruded profile is paired to copper wires. To avoid the formation of unwanted tensions in the rail formed in the calibration unit, and to confer a sufficient plasticity to wires 4, before inserting them in the calibration station, the same electric wires 4 are heated to a temperature near to that of the extruded plastic forming the rail body; usually this temperature is kept between 60 and 100° C.

the extrusion-wires pair is longitudinally pulled and cooled;

the extrusion-wires pair is cut in tracts of suitable length.

During the cutting step pressing and counter-pressing means are used, to hold electric wires 4 in their respective slots. This occurs in an understandable and easily feasible way for a skilled person.

Figure 4:
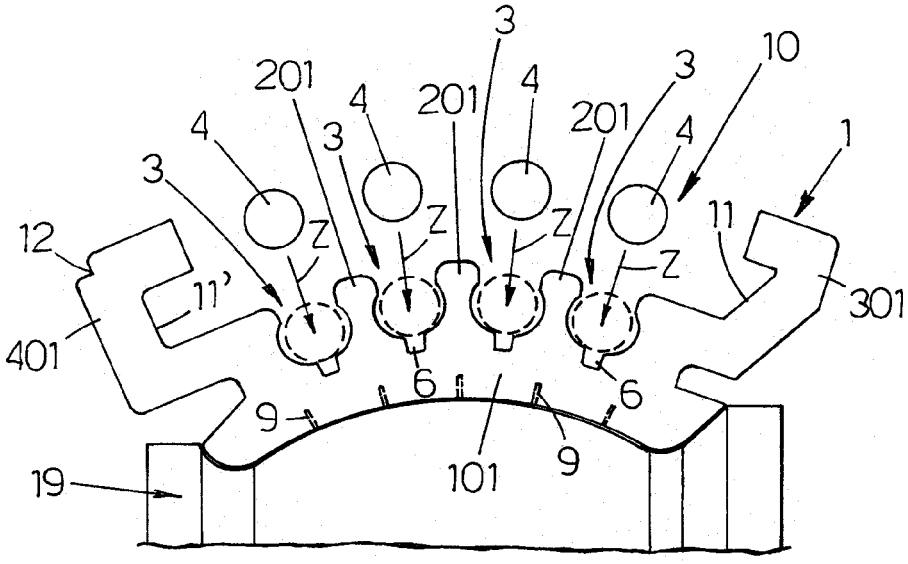
FIGS. 4 and 5 show the electrified rail transversally sectioned in successive steps of the production cycle.

During the calibration step, the extruded plastic profile 101, 201, 301, 401 undergoes a transversal bending as shown in FIG. 4, so that the channel 10 of the extrusion itself outwardly opens with a divergent profile, and the slots 3 open and widen, so that into them electric wires 4 can be rapidly and tangentially inserted, without substantial interference with wall 201 of slots 3, as shown in FIG. 4 by arrows Z. Suitable non illustrated means, easily imagined by the skilled person, are provided to lead and progressively insert wires 4 into slots 3 of the extruded profile, as schematically indicated by arrows Z.

From FIG. 4 it is apparent how the longitudinal grooves 6 on the bottom of slots 3, and the optional small grooves 9 on the external side of the base 2 of the extruded profile, act as flexion hinges which allow to bring the extruded profile from the condition illustrated in FIG. 1 to that in FIG. 4 in an elastic-plastic way, and without dangerous tension both in slots 3 and in the other parts of the section of the same extruded profile. In FIG. 4 it is apparent that the same grooves 6, notwithstanding the small elastic deformation they undergo, thank to their limited dimensions in width and length, act as end of stroke and centring reference to ensure the correct placement of wires 4 on the bottom of slots 3. The wires 4 will never be able to enter into grooves 6, as it could occur if said grooves had a width equal to that of the mouth 103 with which the slots 3 outwardly open. In a step following that illustrated in FIG. 4, in the final area of calibration unit, through suitable rollers or other inferior, superior, external and internal lateral leading means, as partially indicated by 20 in FIG. 5, the profile 1 is closed and brought back to nominal measures as in FIG. 1, so that it arrives to the following cooling station already with a defined form, thanks also to the elastic memory of the extruded plastic profile coming out from the extruder.

Figure 5:
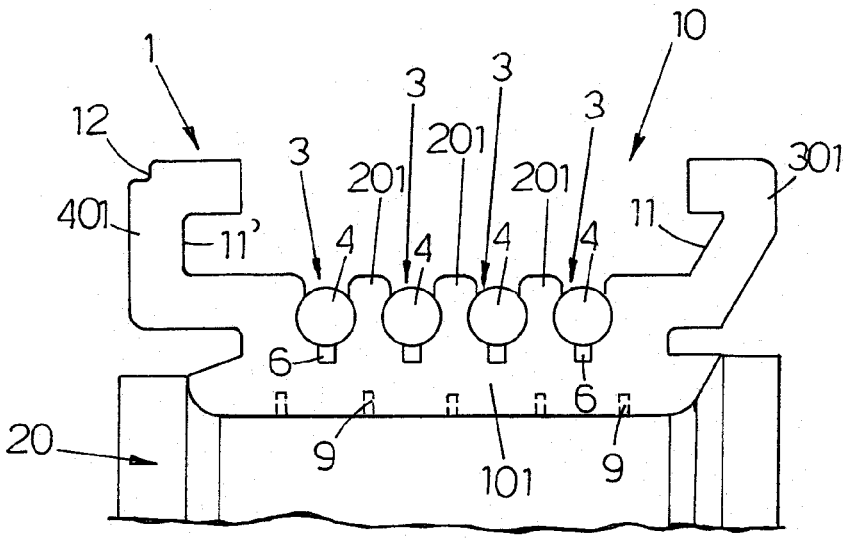

It is apparent from FIG. 5 that the grooves 6 allow a faster cooling of the electric wires 4. Also the optional grooves 9 and 7, 8, 10, 11, 12 of rail 1 will contribute to a rapid and uniform dissipation of the heat generated during the production, ensuring a correct profile and linearity of the rail itself.

Figure 6:
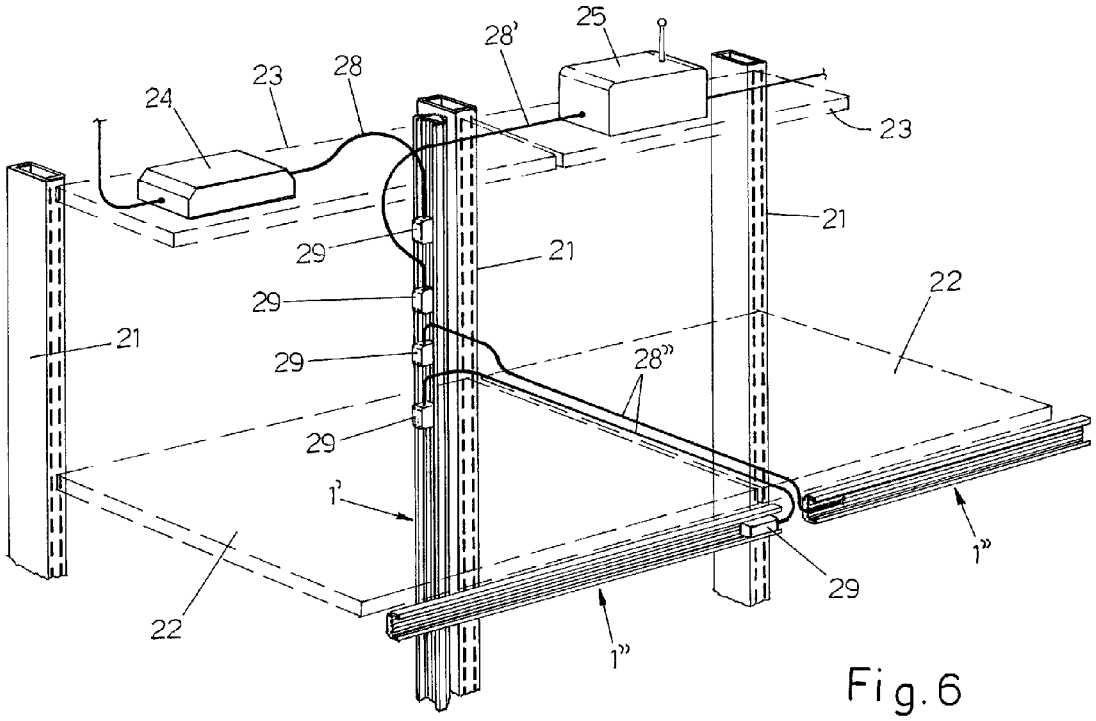
FIG. 6 shows schematically and in perspective the use of the electrified rail according to the present invention for metal shelves supporting goods.
Figure 7:
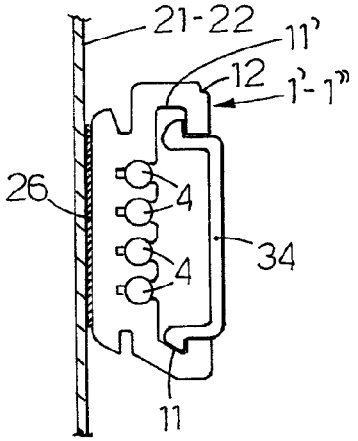
FIGS. 7 and 8 show two different ways of installing the electrified rail or of fixing devices to it.
Figure 8:
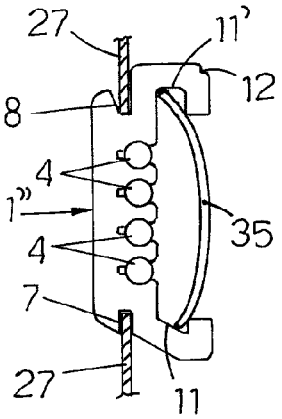
Figure 10:
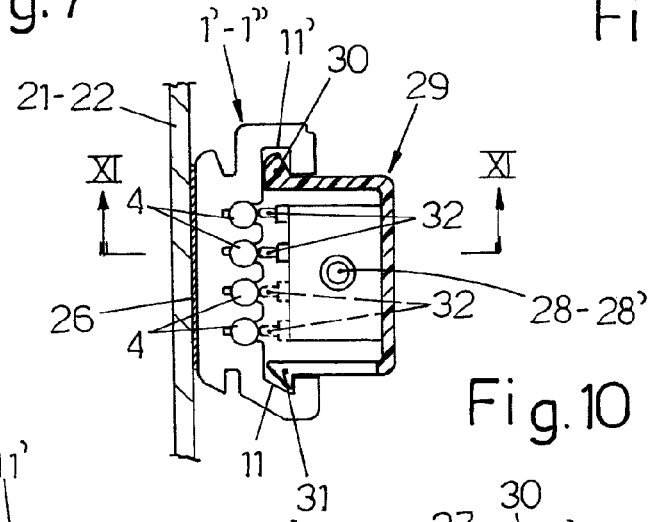
FIG. 10 shows the fixing of a plug with electric wires.

In FIG. 6, 21 indicates the uprights of a shelving unit, which support shelves 22 supporting goods. Such shelving unit can be provided in its top part with one or more auxiliary shelves 23 for supporting means 24 capable of supplying low voltage to telemetric means 25, suitable for providing and transmitting data. The electrified rail of the present invention can be fixed laterally substantially on the whole vertical extension of uprights 21, as indicated with 1', and can be moreover fixed on the whole extension of the front horizontal side of the shelves 22, as indicated with 1" in the same FIG. 6, e.g. with adhesive or bi-adhesive band 26 as in FIG. 7, applied on the rear side 2 of the rail itself, or with hooking means 27 as in FIG. 8, which engage lateral grooves 7, 8 of the rail itself. The vertical rail 1' can be connected to means 24 and 25 with respective electric wires 28, 28', provided with electric plugs 29 of the type illustrated in FIGS. 10 and 11, having a body with flexible lateral wings and with hooking profile 30, 31, for release fixing and with obliged orientation into internal channels 11, 11' of the rail and provided with spring-loaded pins 32, of telescopic type and axial springing, having a diameter of about 1 mm, preferably nickel- or gold-plated, and with rounded head.

Figure 11:
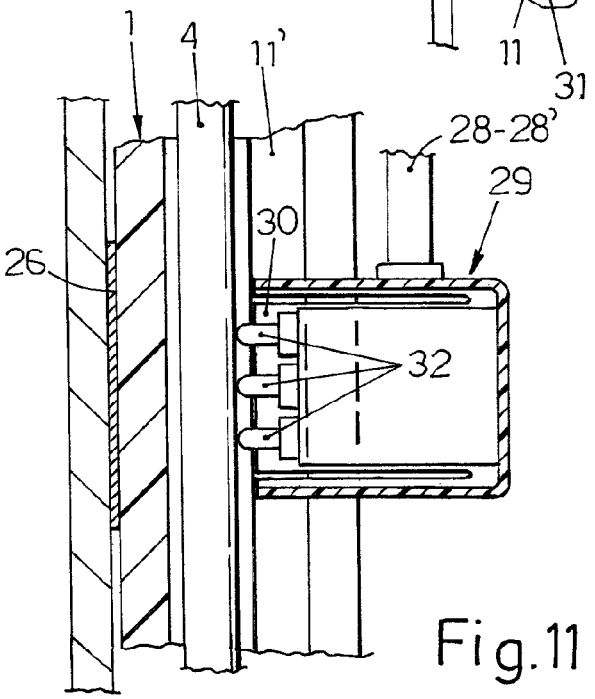
FIG. 11 shows other details of the group plug-and-socket of FIG. 10, longitudinally sectioned according to line XI-XI.

In FIG. 11 it is shown that, in case of need, the plug 29 can be provided with a plurality of pins 32 in contact with the same wire 4 of rail, every time it is necessary to form contact areas having wide surface and better electric conductivity.

Figure 9:
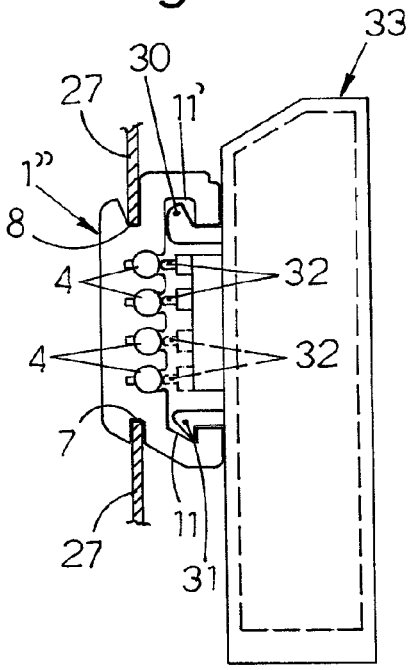
FIG. 9 shows the fixing of an electronic label or other peripheral to the electrified rail.

Always in FIG. 6 it is shown that through similar plugs 29 and relative wiring 28" the vertical rail 1 can be electrically connected to horizontal rails 1", on which electronic labels 33 can be release fixed, as in the example of FIG. 9. They, too, are provided with axial spring-loaded pins 32, which will contact the necessary wires 4 of the rail 1" itself. The electronic labels 33, too, are provided with appendixes 30, 31 for a release fixing and with obliged orientation into internal channels 11, 11' of said rail 1". It is understood that the horizontal rails 1" can be fixed with bi-adhesive bands 26 like in the solution of FIG. 7, and that lateral channels 7, 8 can be used for fixing to the rail itself any accessory component, as already said for the embodiment of FIG. 1*a*. The tracts of horizontal 1" and vertical 1' rails, which are not engaged with plugs 29 and electronic labels or other accessory parts, can be release-closed and protected with flexible and electrically insulating coverings, which can be profiled as indicated with 34 in the embodiment of FIG. 7. Alternatively, they can be obtained with the transversal fractioning of a simple plastic band, as indicated with 35 in the embodiment of FIG. 8.

Thanks to the particular configuration of the rail, according to which all wires are lying on the same flat in-sight surface 102, in combination with a spring loaded contact pin having a preferably rounded point, it is achieved that the plug can slide longitudinally along the axis of the rail without losing the electric contact and without leaving damage grooves on the wires. This feature is obtained in combination with the use of nickel-plated or gold-plated contact surfaces, which prevent the formation of oxides and which render unnecessary the mechanical penetration of the metals.

It is understood that to the present invention numerous variants and modification can be introduced, without for this departing from the underlying principle of the invention as described, illustrated and claimed in the following.

In the claims, the reference numbers shown in brackets are purely indicative and do not limit the scope of protection of the claims.

What is claimed is:

1. An electrified rail for the electrification of metal shelving units provided with electronic peripherals, the rail comprising a flexible body of electrically insulating plastic material, provided with longitudinal slots distanced to each other, in every one of which a wire or strand of electrically conducting metal is surrounded for more than 180° of a cross section by the internal walls of the respective slot, to be friction-held therein, the remaining section of the same wire or electrically conducting metal being exposed and disposable in electrical communication with an electric contact useful to connect the wire or electrically conducting metal to an electronic device, fixed to said body of the rail, the body of the rail being formed in a monolithic way of a polymer material with high electric insulation and with high heat resistance, said slots containing the electric wires or electrically conducting metal are configured to be flexed open to ease the insertion of the electric wires or electrically conducting metal, the slots being provided with longitudinal middle grooves configured to allow a transversal elastic deformation of the rail, each groove having a width that is inferior to the width of an outward opening mouth of the corresponding slot, said slots being positioned one beside the other, and the wires or electrically conducting metal disposed therein; each slot having a depth perpendicular to said visible side and sufficient to enable the corresponding wire or electrically conducting metal to be disposed in the slot, the wires or electrically conducting metal being held in the slots by the material forming the monolithic body of the rail, wherein the body of the rail is provided with longitudinal grooves in an offset symmetrical position with respect to the slot longitudinal grooves and adapted to allow transversal deformation of the rail.

2. The electrified rail according to claim 1, wherein wires or electrically conducting metal are nickel-plated or gold-plated, and are connectable to peripherals and connecting plugs having contact pins of telescopic type, internally spring-loaded and with rounded nickel-plated or gold: plated contact points.

3. The electrified rail according to claim 1, wherein the body has a substantially flat profile, provided with a planar side, on which said wire holding slots open, and provided with a planar side opposed to the preceding side, suitable for fixing on a supporting surface through adhesive or bi-adhesive bands, being provided on its sides of external longitudinal grooves having different configurations.

4. The electrified rail according to claim 1, having a body with one of a substantially U-profile and C-profile, having a longitudinal channel on whose planar bottom slots are open for holding the wires or electrically conducting metal; the sides of channel being sized to engage with profiles having shape and/or different dimensions to hook with obliged and correct orientation appendixes of peripherals and of electric plugs, the body of rail being provided with a planar surface for fixing on a support surface; the rail being provided on its sides of external and longitudinal grooves to allow the installation of said rail with optional lateral support means and/or to support with such lateral groove accessory parts.

5. The electrified rail according to claim 4, having an overall width respectively of about 19-20 mm, a thickness of 4-8 mm, having a longitudinal channel of depth (P) of about 3.45 mm and having four longitudinal slots each holding the electric wire or electrically conducting metal having a section of 1.4-1.8 mm, distanced to each other with a pitch of about 2.54 mm, the slots being outwardly open with a mouth having a width of about 1.3 mm and a depth of about 0.4 mm.

6. The electrified rail according to claim 1, having external references providing orientation information, in consequence of the different intended use of the electric wires or electrically conducting metal, that reference being formed by at least a longitudinal groove placed in a visible area of the body of the rail itself.

7. The electrified rail according to claim 1, made of one of a transparent material and a translucent material, in order to have a limited aesthetic impact, or to aesthetically adapt to shelves or other parts of shelving units of any color.

8. A method for the manufacturing of the electrified rail according to claim 1, wherein the body is formed via an extrusion step, after the extrusion step the method comprises a calibration step, a cooling step, a longitudinal pulling step of the extruded and cooled profile, and a final transversal cut step to obtain tracts having the desired length, comprising during the calibration step the extruded plastic profile forming the rail is transversally bent so that surface on which longitudinal slots are present and open is made outwardly convex, so that said slots further open and assume a transversal profile outwardly diverging, and take a width allowing to tangentially introduce the electric wires or electrically conducting metal therein, in a continuous way and without substantial interference with the relative lateral walls, and comprising the respective electric wires or electrically conducting metal are suitably heated while rail body is still hot, and are introduced while heated in a tangential and continuous way into said slots successively brought back to its original and final profile, to incorporate and tightly hold electric wires or electrically conducting metal in respective slots.

* * * * *